US009416622B2

(12) United States Patent
Least

(10) Patent No.: US 9,416,622 B2
(45) Date of Patent: Aug. 16, 2016

(54) RESILIENT DOWNHOLE FLOW RESTRICTOR

(75) Inventor: Brandon Thomas Least, Dallas, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 483 days.

(21) Appl. No.: 13/993,738

(22) PCT Filed: Sep. 12, 2012

(86) PCT No.: PCT/US2012/054721

§ 371 (c)(1),
(2), (4) Date: Jun. 13, 2013

(87) PCT Pub. No.: WO2014/042619

PCT Pub. Date: Mar. 20, 2014

(65) Prior Publication Data

US 2014/0069627 A1 Mar. 13, 2014

(51) Int. Cl.
*E21B 34/08* (2006.01)
*E21B 43/04* (2006.01)

(52) U.S. Cl.
CPC ..... *E21B 34/08* (2013.01); *E21B 43/04* (2013.01)

(58) Field of Classification Search
CPC ..... E21B 34/06; E21B 43/04; E21B 34/08; B01D 33/00; B01D 33/01; B01L 3/5021; B01L 3/14; G01D 33/01; G01N 33/49
See application file for complete search history.

(56) References Cited

U.S. PATENT DOCUMENTS

| | | | | |
|---|---|---|---|---|
| 3,422,903 | A * | 1/1969 | Jansson | E21B 17/00 137/512.4 |
| 3,586,104 | A | 6/1971 | Hyde | |
| 3,661,265 | A * | 5/1972 | Greenspan | B01D 33/01 210/359 |
| 6,464,007 | B1 | 10/2002 | Jones | |
| 2005/0045327 | A1 | 3/2005 | Wang et al. | |
| 2011/0005629 | A1 | 1/2011 | Ostrander et al. | |
| 2011/0056569 | A1 | 3/2011 | Chambo et al. | |
| 2011/0139465 | A1 | 6/2011 | Tibbles et al. | |

FOREIGN PATENT DOCUMENTS

| | | |
|---|---|---|
| FR | 1301646 | 8/1962 |
| GB | 2471609 | 1/2011 |
| WO | 2012085556 | 6/2012 |

OTHER PUBLICATIONS

Halliburton, First Delta Stim® Completion System Deployed in the Eagle Ford Shale; Saves Customer $1 Million, Case history, available online at http://www.halliburton.com/public/cps/contents/Case_Histories/web/H07303_Eagle%20Ford.pdf, at least as early as Dec. 2009, 2 pages.

(Continued)

*Primary Examiner* — Yong-Suk (Philip) Ro
(74) *Attorney, Agent, or Firm* — Kilpatrick Townsend & Stockton LLP

(57) ABSTRACT

A flow restrictor includes resilient flaps that can flex outward to an open position in response to fluid flow pressure and return to an initial position at which the resilient flaps restrict fluid flow more than in the open position. The resilient flaps can overlap and variably restrict fluid flow based on fluid flow pressure. The flow restrictor can be used on a transport tube to avoid a need for a packing tube in an alternative path system to deliver gravel packing slurry.

5 Claims, 6 Drawing Sheets

(56) References Cited

OTHER PUBLICATIONS

Halliburton, Sand Control Screen and Inflow Control Technology Solutions, Product Brochure, available online at http://www.halliburton.com/public/cps/contents/Brochures/web/H08391.pdf, at least as early as Apr. 2012, 2 pages.

Eberhard, Sliding sleeve completions, Halliburton, Williston Basin Petroleum Conference, available online at http://wbpc.ca/pub/documents/archived-talks/2010/Mike__Eberhard__-__Halliburton.pdf, 2009, 7 pages.

Baker Hughes, Equalizer-CF Completion Solution Reduced Pay Zone Losses in Mature Field, Case history, available online at http://public.bakerhughes.com/completions-leader/case__histories/03__inflow__control/EQUALIZER-CF%20Completion%20Solution%20Reduced%20Pay%20Zone%20Losses-%20in%20Mature%20Field.pdf, 2011, 1 page.

International Patent Application No. PCT/US2012/054721, "International Search Report and Written Opinion", mailed Mar. 11, 2013 (11 pages).

Australian Application No. 2012389852, Second Examiner Report mailed on Jan. 22, 2016, 4 pages.

European Patent Application No. 12884409.9, Extended European Search Report mailed Jun. 3, 2016, 10 pages.

* cited by examiner

RESILIENT DOWNHOLE FLOW RESTRICTOR

CROSS-REFERENCE TO RELATED APPLICATIONS

This is a U.S. national phase under 35 U.S.C. 371 of International Patent Application No. PCT/US2012/054721, titled "Resilient Downhole Flow Restrictor," filed Sep. 12, 2012, the entirety of which is incorporated herein by reference.

TECHNICAL FIELD OF THE INVENTION

The present invention relates generally to flow restrictors for controlling fluid flow in a downhole environment of a subterranean formation and, more particularly (although not necessarily exclusively), to flow restrictors for use with alternative path systems and that include resilient flaps that can change position and facilitate downhole operations, such as gravel packing.

BACKGROUND

Various devices can be installed in a well traversing a hydrocarbon-bearing subterranean formation. Some devices facilitate gravel packing operations, which can involve introducing a slurry mix downhole through a main transport tube for deposition of gravel or sand included in the slurry mix in an annulus in the wellbore. Alternative path systems, such as shunt tubes, can be used as a backup to the main transport tube to allow delivery of the slurry mix in the annulus even if the main transport tube is blocked. Packing tubes may be included with shunt tubes. The packing tubes can include openings through which the slurry can be delivered to the annulus. Slurry can be delivered through the packing tube openings instead of from the shunt tubes because including openings in the shunt tubes may risk high leak off of fluid from the slurry, which may result in gravel or sand blocking flow in the shunt tubes.

Simpler alternative path systems, however, are desirable. For example, alternative path systems are desirable that can deliver slurry to an annulus without requiring additional tubes, such as packing tubes, and that avoid issues associated with unintended fluid leak off from the slurry.

SUMMARY

Certain aspects of the present invention are directed to a flow restrictor that includes resilient flaps that can variably restrict fluid flow based on fluid flow pressure and prevent unintended fluid leak off to avoid the need for additional tubes in a gravel packing system.

One aspect relates to a flow restrictor that can be disposed on a component in a wellbore of a subterranean formation. The flow restrictor includes a plurality of resilient flaps that overlap each other. The resilient flaps can flex outwardly into the wellbore to an open position in response to fluid flow pressure in an inner area of the component. The resilient flaps can return to an initial position at which the resilient flaps restrict fluid flow more than in the open position.

Another aspect relates to a transport tube that can be an alternative flow path to a main tube in a wellbore. The transport tube includes a flow restrictor on an outer surface of the transport tube. The flow restrictor includes resilient flaps that can at least partially overlap in a closed position. The resilient flaps can flex outwardly to an open position in response to fluid flow pressure in an inner area of the transport tube. The resilient flaps can return to the closed position from the open position.

Another aspect relates to a gravel packing assembly that can be disposed in a wellbore. The gravel packing assembly includes:

a main tube for providing a main flow path for gravel packing slurry;

a transport tube for providing an alternative flow path to the main flow path for the gravel packing slurry;

a flow restrictor on a surface of the transport tube, the flow restrictor comprising a plurality of resilient flaps that overlap and that are configured for flexing outwardly to a bend position in response to flow pressure in an inner area of the transport tube and for returning to an initial position, wherein the plurality of resilient flaps are configured for variably restricting flow of the gravel packing slurry between the initial position and the bend position based on the flow pressure in the transport tube.

These illustrative aspects and features are mentioned not to limit or define the invention, but to provide examples to aid understanding of the inventive concepts disclosed in this disclosure. Other aspects, advantages, and features of the present invention will become apparent after review of the entire disclosure.

DETAILED DESCRIPTION

Certain aspects and features relate to a flow restrictor including resilient flaps that can flex outward to an open position in response to fluid flow pressure and return to an initial position at which the resilient flaps restrict fluid flow more than in the open position. Examples of flow restrictors include nozzles and valves that can be positioned in a wellbore with a sub-system component.

The flow restrictor can be included with a gravel packing sub-system that includes an alternative path system, such as a shunt tube. The flow restrictor may be located on a surface of the alternative path system. The resilient flaps can open in response to fluid flow pressure in the alternative path system exceeding a threshold and allow fluid, which may include a gravel pack slurry, to flow without substantial restriction into an annulus about the alternative path system. Subsequent to an area of the annulus that is proximate to the flow restrictor filling with sand, the flaps can return to the initial position.

The resilient flaps may be made from a flexible material and may be normally in a closed position. The resilient flaps can be configured to open in only one direction and return to the initial position after a fluid flow pressure is below a certain threshold. The resilient flaps in the closed position may include a small gap that can reduce pressure differential across the flow restrictor, but reduce leak off of water or other carrier for slurry in the alternative path system. The resilient flaps that can reduce leak off can be used with alternative path systems that do not require use of packing tubes.

The flexible material may be any material that is not permanently deformable, does not erode or degrade, and is resilient. Examples of flexible material include stainless steel and elastic material.

These illustrative aspects and examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative aspects but, like the illustrative aspects, should not be used to limit the present invention.

Figure 1:
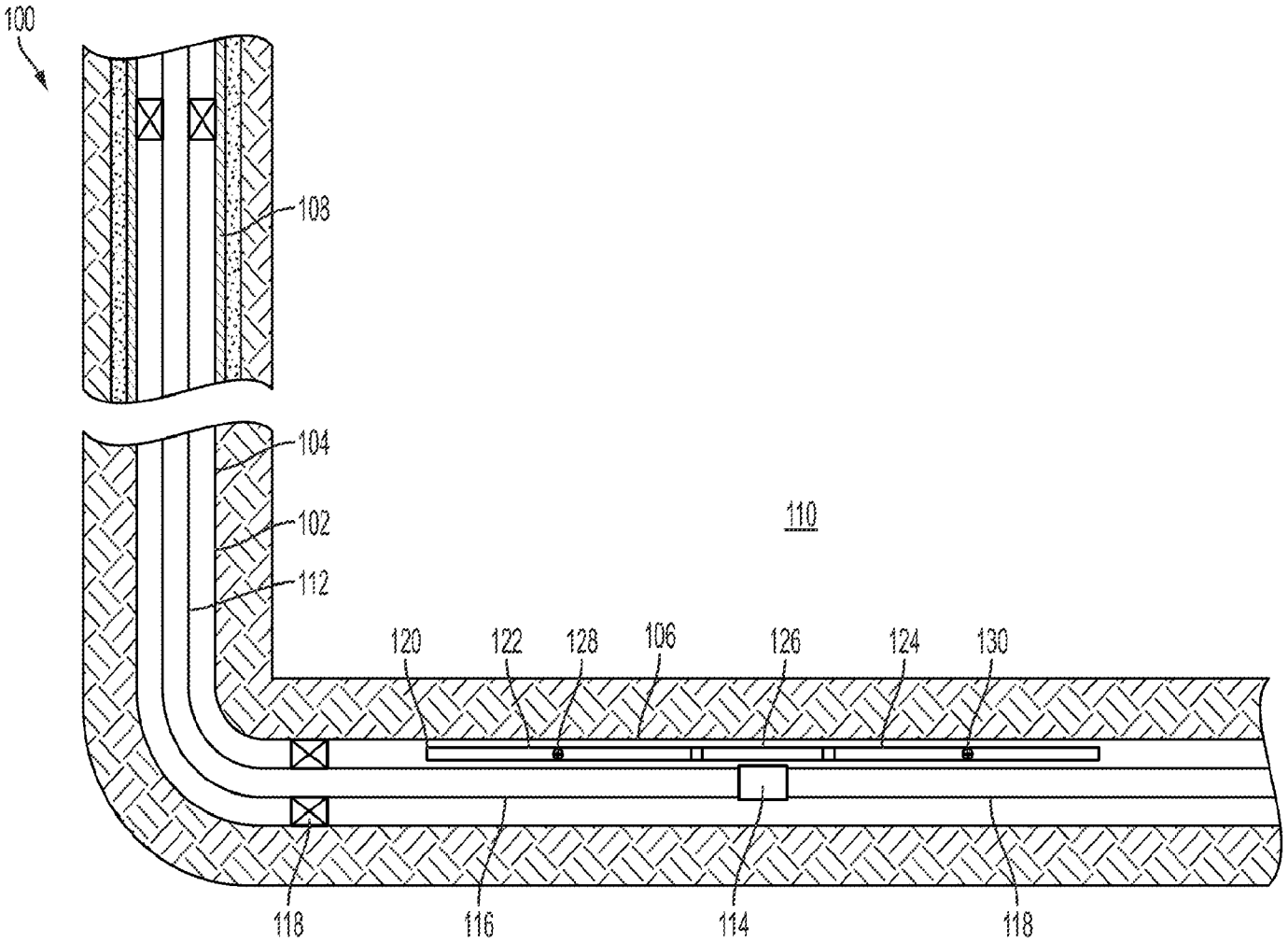
FIG. 1 is a schematic illustration of a well system having alternative path systems including flow restrictors according to one aspect of the present invention.

FIG. 1 depicts a well system 100 with flow restrictors according to certain aspects of the present invention. The well system 100 includes a bore that is a wellbore 102 extending through various earth strata. The wellbore 102 has a substantially vertical section 104 and a substantially horizontal section 106. The substantially vertical section 104 and the substantially horizontal section 106 may include a casing string 108 cemented at an upper portion of the substantially vertical section 104. The substantially horizontal section 106 extends through a hydrocarbon bearing subterranean formation 110.

A tubing string 112 extends from the surface within wellbore 102. The tubing string 112 can provide a conduit for gravel pack slurry to travel from the surface to the substantially horizontal section 106. A base pipe coupling 114 can couple two sections 116, 118 of the tubing string 112. Included in an annulus about the tubing string sections 116, 118 is an alternative path system 120. The alternative path system 120 includes transport tubes 122, 124, which may be shunt tubes, and a jumper tube 126. Included on the transport tubes 122, 124 are flow restrictors 128, 130.

Although FIG. 1 depicts tubing string sections 116, 118 that can include flow restrictors 128, 130 positioned in the substantially horizontal section 106, tubing string sections 116, 118 (and flow restrictors 128, 130) according to various aspects of the present invention can be located, additionally or alternatively, in the substantially vertical section 104. Furthermore, any number of tubing string sections having flow restrictors, including one, can be used in the well system 100. In some aspects, tubing string sections having flow restrictors can be disposed in simpler wellbores, such as wellbores having only a substantially vertical section. Flow restrictors can be disposed in open hole environments, such as is depicted in FIG. 1, or in cased wells.

Figure 2:
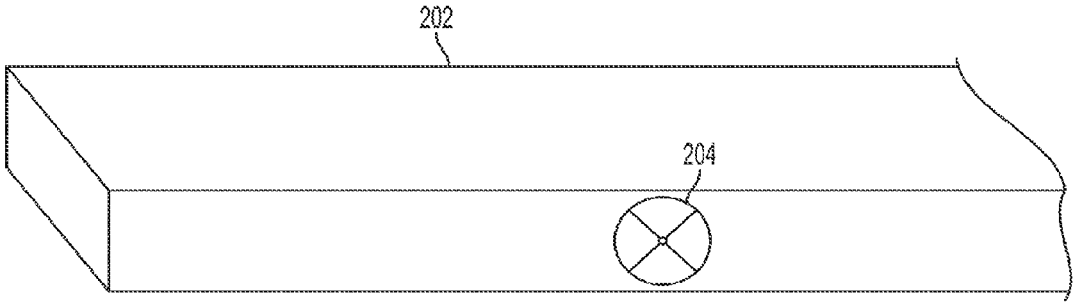
FIG. 2 is a perspective view of an alternative path system that includes a flow restrictor on a surface thereof according to one aspect of the present invention.

FIG. 2 depicts part of an alternative path system that is a transport tube 202. The transport tube 202 includes an inner area (not shown) that can carry fluid, such as slurry. On a surface of the transport tube 202 is an opening in which is located a flow restrictor 204. The flow restrictor 204 can open in response to fluid flow pressure in the inner area of the transport tube exceeding a threshold. The flow restrictor 204 can subsequently return to an initial position in response to pressure falling below the threshold.

The transport tube 202 shown in FIG. 2 has a rectangular cross-section. Transport tubes according to other aspects may be round or otherwise have cross-sections of a shape other than rectangular. Furthermore, the flow restrictor 204 in FIG. 2 is circular. Flow restrictors according to other aspects can have shapes other than circular, such as rectangular, square, and five-sided.

Figure 3A:
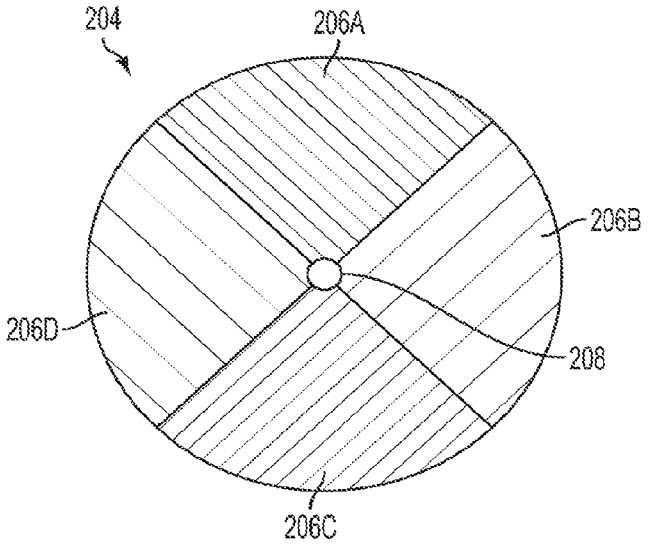
FIG. 3A is a top view of a flow restrictor in a closed position according to one aspect of the present invention.
Figure 3B:
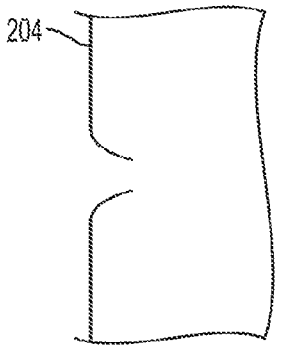
FIG. 3B is a side view of the flow restrictor of FIG. 3A according to one aspect of the present invention.

FIGS. 3A-3B depict the flow restrictor 204 in an initial or "closed" position. The flow restrictor 204 includes four resilient flaps 206A-D. Each of the flaps 206A-D extends from an edge of the flow restrictor 204 toward a gap 208 formed by ends of the flaps 206A-D. An edge of the flow restrictor 204 may be coupled to the surface of a transport tube or to a housing of the flow restrictor. In the initial or "closed" position, the flaps 206A-D can substantially restrict fluid from flowing between an inner area of the transport tube to an outer area of the transport tube, but the gap 208 can reduce pressure differential across the flow restrictor 204. The flaps 206A-D can overlap each other to increase restriction of flow.

Figure 4A:
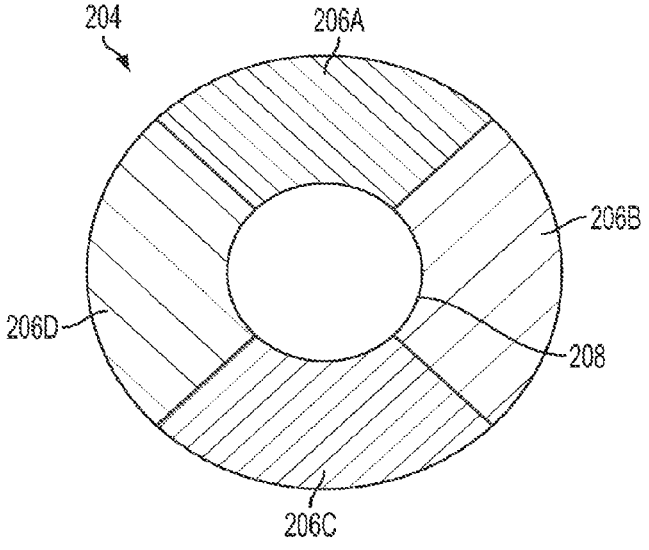
FIG. 4A is a top view of a flow restrictor in an open position according to one aspect of the present invention.
Figure 4B:
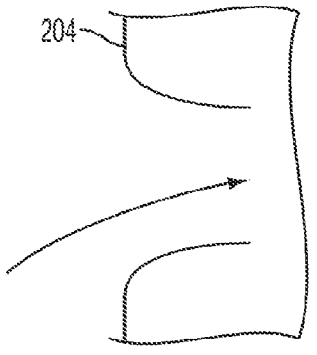
FIG. 4B is a side view of the flow restrictor of FIG. 4A according to one aspect of the present invention.

FIGS. 4A-4B depict the flow restrictor 204 in an open position in response to fluid flow pressure from an inner area of the transport tube exceeding a threshold. In the open position, the flaps 206A-D flex outwardly such that the gap 208 is enlarged to be an opening through which fluid can flow without substantial restriction, as represented by the arrow in FIG. 4B. For example, at least part of the flaps 206A-D can bend in response to the fluid flow pressure exceeding a threshold such that the distance between ends of the flaps 206A-D is enlarged to create the opening. The fluid flow pressure may be a function of slurry fluid pumped into the wellbore. The opening may be any suitable size to allow fluid flow without substantial restriction as compared to the initial or "closed" position. An example of a suitable size is one in the range of one-quarter inch to three-eighths inch.

The flaps 206A-D can transition from the initial position to the open position in response to changes to fluid flow pressure and variably restrict fluid flow based on the fluid flow pressure. For example, after fluid flow pressure exceeds a certain threshold at which the flaps 206A-D begin to flex, the flaps 206A-D can flex outwardly at a rate that is based on a rate of increase in the fluid flow pressure.

Figure 5A:
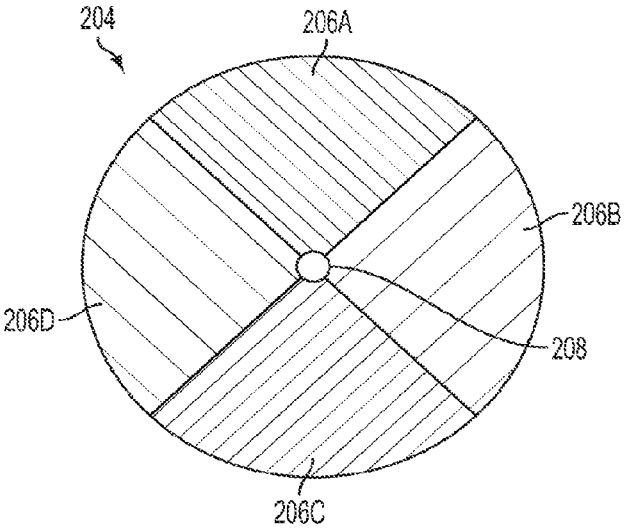
FIG. 5A is a top view of a flow restrictor returned to the closed position according to one aspect of the present invention.
Figure 5B:
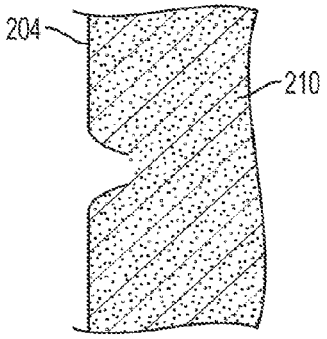
FIG. 5B is a side view of the flow restrictor of FIG. 5A with sand deposed on one side of the flow restrictor according to one aspect of the present invention.

FIGS. 5A-5B depict the flow restrictor 204 returned to the initial or "closed" position in response to sand 210 or other medium filling the area external to the transport tube and proximate to the flow restrictor 204. The sand 210 or other medium can cause flow from the area internal to the transport tube to reduce flow rate and pressure exerted on the flaps 206A-D. The flaps 206A-D can be resilient by returning the initial or "closed" position after the fluid flow pressure is reduced below a certain threshold.

Figure 6:
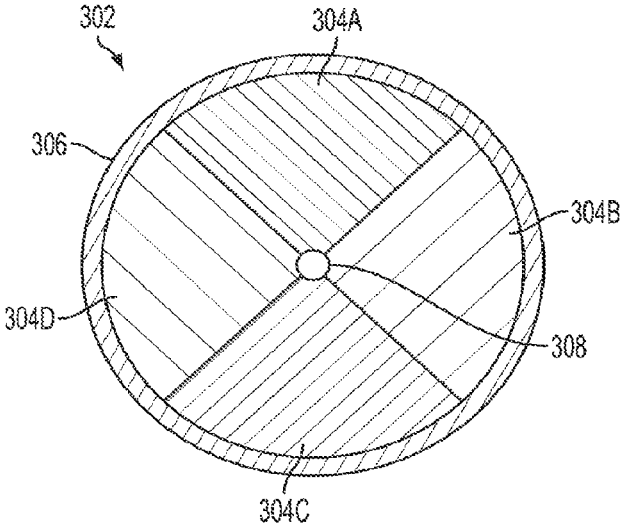
FIG. 6 is a top view of a flow restrictor that includes a housing according to one aspect of the present invention.
Figure 7:
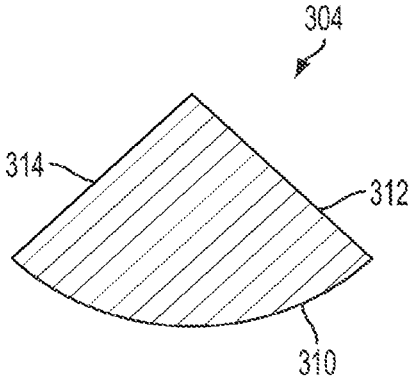
FIG. 7 is a top view of a flap of a flow restrictor according to one aspect of the present invention.

FIG. 6 depicts a flow restrictor 302 according to another aspect. The flow restrictor 302 includes resilient flaps 304A-D and a housing 306 to which portions of the flaps 304A-D are coupled. The housing 306 may be made from a rigid metal or other substance and can be coupled to a transport tube or other oilfield sub-assembly. Each of the flaps 304A-D extends from the housing 306 toward a gap 308 formed by the ends of the flaps 304A-D. As shown in FIG. 7, each flap 304 includes a curved edge 310 and two edges 312, 314 that extend from the curved edge 310 to a point that is an end of the flap 304.

Figure 8:
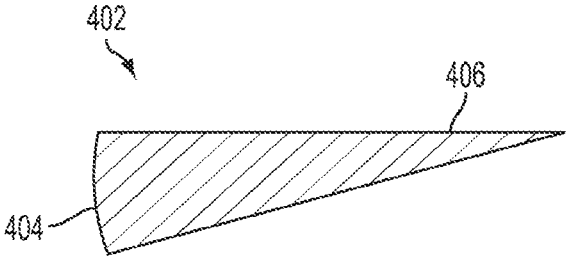
FIG. 8 is a side view of a flap of a flow restrictor according to one aspect of the present invention.

Resilient flaps according to various aspects can each have variable thicknesses. FIG. 8 depicts by side view a resilient flap 402 according to one aspect that has a greater thickness at a first portion 404 than at a second portion 406 with a linear change in thickness between the first portion 404 and the second portion 406. The first portion 404 may couple the flap 402 to a housing or transport tube. The thickness of the first portion 404 may prevent the first portion 404 from flexing in response to fluid flow pressure above a certain threshold, but below an extraordinary threshold at which pressure may damage the alternative path system in any event. The thickness of the second portion 406, and at least part of the portion between the first portion 404 and the second portion 406, may flex outwardly in response to fluid flow pressure above a certain threshold.

Figure 9:
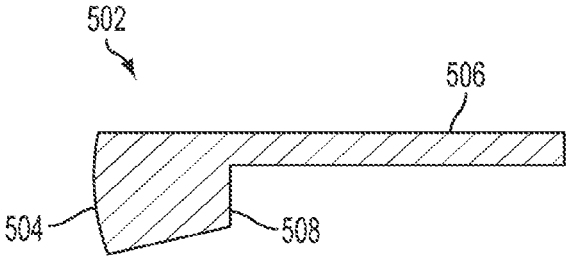
FIG. 9 is a side view of a flap of a flow restrictor according to another aspect of the present invention.

FIG. 9 depicts a resilient flap 502 according to another aspect that includes two defined portions 504, 506 having different thicknesses, the thickness of portion 504 being greater than that of portion 506. The resilient flap 502 does not include a linear transition from a maximum thickness to a minimum thickness as in the resilient flap 402 of FIG. 8. Instead, the thickness between portions 504, 506 changes abruptly at transition point 508. In other aspects, the transition point 508 includes a linear or curved portion that provides a less abrupt transition between the thicknesses than is shown in FIG. 9.

Figure 10A:
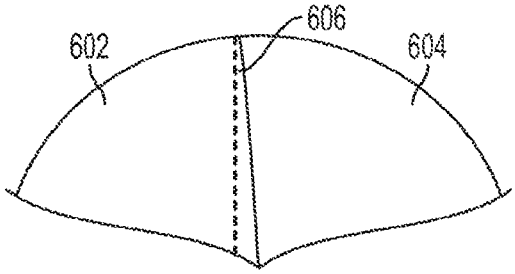
FIG. 10A is a top view of overlapping flaps of a flow restrictor according to one aspect of the present invention.
Figure 10B:
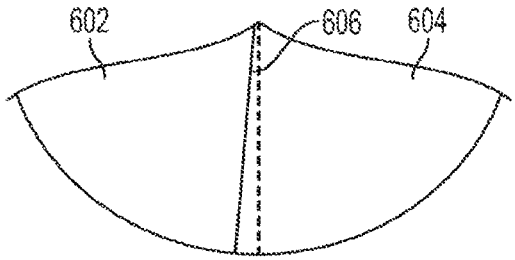
FIG. 10B is a bottom view of the overlapping flaps of FIG. 10A according to one aspect of the present invention.

As described previously, resilient flaps can overlap each other to facilitate fluid flow restriction. FIGS. 10A-10B depict two flaps 602, 604 that overlap each other to form an overlapping area 606. An edge of flap 602 is shown as being above flap 604 in FIG. 10A and an edge of flap 604 is shown as being below flap 602. The arrangement is reversed when viewed from the bottom view shown in FIG. 10B.

Resilient flaps according to various aspects can be any shape. In some aspects, flaps of a flow restrictor have different shapes. In some aspects, the flaps can overlap to form a gap or opening that is not centered or otherwise in the middle of an area defined by the flow restrictor.

The foregoing description of the aspects, including illustrated aspects, of the invention has been presented only for the purpose of illustration and description and is not intended to be exhaustive or to limit the invention to the precise forms disclosed. Numerous modifications, adaptations, and uses thereof will be apparent to those skilled in the art without departing from the scope of this invention.

What is claimed is:

1. A gravel packing assembly configured for being disposed in a wellbore, the gravel packing assembly comprising:

a main tube for providing a main flow path for gravel packing slurry; a transport tube for providing an alternative flow path to the main flow path for the gravel packing slurry; and a flow restrictor for use downhole, the flow restrictor being on a surface of the transport tube and comprising a plurality of resilient flaps that overlap each other and that are configured for flexing outwardly from a first position that forms a gap to a second position that forms an opening larger than the gap in response to flow pressure in an inner area of the transport tube and for returning to the first position, wherein the plurality of resilient flaps are configured for variably restricting flow of the gravel packing slurry between the first position and the second position based on the flow pressure in the transport tube.

2. The gravel packing assembly of claim 1, wherein the gap being configured to reduce a pressure differential across the flow restrictor, wherein the opening being adapted to allow the gravel packing slurry to flow from the inner area of the transport tube to an area external to the transport tube, wherein the plurality of resilient flaps is configured for returning to the first position in response to sand filling an external area to the transport tube and proximate to the flow restrictor, the plurality of resilient flaps in the first position being configured to reduce loss of carrier fluid from the gravel packing slurry in the inner area of the transport tube.

3. The gravel packing assembly of claim 1, wherein each of the plurality of resilient flaps comprises:

a first portion coupled to a flow restrictor housing; and a second portion extending from the first portion, the second portion being thinner than the first portion and configured for flexing outwardly to the second position.

4. The gravel packing assembly of claim 1, wherein the flow restrictor is circular, wherein each of the plurality of resilient flaps comprises:

a curved edge at a flow restrictor housing; and two edges extending from the curved edge toward a gap or opening.

5. The gravel packing assembly of claim 1, wherein the flow restrictor is a nozzle.

* * * * *